US006923683B2

(12) United States Patent
Dulai et al.

(10) Patent No.: US 6,923,683 B2
(45) Date of Patent: Aug. 2, 2005

(54) HIGH DENSITY INTERCONNECTION DEVICE

(75) Inventors: Harjinder Dulai, Unionville (CA); Yen-Ming Chen, Markham (CA); Colin Szeto, North York (CA); Edward J. Laurin, Etobicoke (CA); Steven D. Daniels, Thornhill (CA); Jean Francois Drolet, Toronto (CA)

(73) Assignee: ATI Technologies, Inc., Thornhill (CA)

( * ) Notice: Subject to any disclaimer, the term of this patent is extended or adjusted under 35 U.S.C. 154(b) by 0 days.

(21) Appl. No.: 09/921,612

(22) Filed: Aug. 3, 2001

(65) Prior Publication Data

US 2003/0027448 A1 Feb. 6, 2003

(51) Int. Cl.[7] ..... H01R 25/00
(52) U.S. Cl. ..... 439/638
(58) Field of Search ..... 439/638, 639, 439/498, 502, 63, 166; 455/5.1, 4.2; 348/6, 7; 345/132, 156, 87; 361/827, 829, 81, 83

(56) References Cited

U.S. PATENT DOCUMENTS 5,329,427 A * 7/1994 Hogdahl ..... 361/730
5,585,837 A * 12/1996 Nixon ..... 348/6
5,793,352 A * 8/1998 Greenberg ..... 345/132
5,867,223 A * 2/1999 Schindler et al. ..... 348/552
6,169,879 B1 * 1/2001 Perlman ..... 455/6.2

OTHER PUBLICATIONS

Photograph: Top perspective view of a device from 3dfx Interactive, Inc. (1999).
Photograph: Side perspective view of a device from 3dfx Interactive, Inc. (1999).
Photograph: Front perspective view of a device from 3dfx Interactive, Inc. (1999).
Photograph: Top plan view of a device from 3dfx Interactive, Inc. (1999).

* cited by examiner

*Primary Examiner*—J. F. Duverne
(74) *Attorney, Agent, or Firm*—Vedder, Price, Kaufman & Kammohlz

(57) ABSTRACT

A high density interconnection device includes a high density connector block having a plurality of jacks disposed on the outer surface for common interconnected to a high density connector. A recessed portion formed on the first side surface defines a first multi-faceted surface having a plurality of angularly disposed first surface elements. A projecting portion formed on the second side surface defines a second multi-faceted surface having a plurality of angularly disposed second surface elements. In another embodiment, one group of jacks are defined in a first plane, and another group of jacks are defined in a second plane. The first and second planes are substantially parallel such that the first and second groups of jacks are offset.

34 Claims, 3 Drawing Sheets

HIGH DENSITY INTERCONNECTION DEVICE

RELATED CO-PENDING APPLICATIONS

This application is related to co-pending patent application Ser. No. 09/651,154, filed Aug. 30, 2000 by Dulai et al. and owned by instant assignee.

FIELD OF THE INVENTION

The invention relates generally to connecting peripheral devices to a computer, and in particular to a high density audio/video input/output interconnection device for use in interfacing a plurality of peripheral devices with a computer.

BACKGROUND OF THE INVENTION

An expansion board is a printed circuit board that plugs into an expansion slot in a computer or other electronic device. The expansion board extends the computer's ability to control another type of peripheral device. Some such expansion boards that plug into a computer's bus are expansion boards, such as display adapters, disk controllers and sound cards. Typically, the expansion boards plug into expansion slots in the motherboard of the computer. One end of an expansion board has connectors mounted thereon for receiving cables which connect the computer to the peripheral devices. Numerous types of connectors are known in the prior art. For example, keyboards typically use a five pin DIN connector, while the PS/2 connector uses a smaller six pin mini-DIN connector. The PS/2 connectors can be used either for a mouse or a keyboard depending on the design of the computer. DB connectors are widely used in communication and computer services and come in 9, 15, 25, 37 and 50 pin sizes. The pins are arranged either two or three rows on the connectors. A DB-9 connector is commonly used for the first serial port on a personal computer, which is typically connected to the mouse. A high density DB-15 connector is used for the VGA port on a personal computer and typically has fifteen pins in the same shell as the 9 pins in the DB-9 connector.

Other types of connectors are the RCA phonoconnector used for composite video, BNC connectors used for video and networking applications, F connectors for NTSC TV signals, mini-phone connectors for equipment such as headphones and speakers, and DVI connectors for video applications.

With the increase in complex circuitry on expansion boards, and with the desirability of smaller physical equipment cases for personal computers and other devices, some expansion boards use a high density connector to connect numerous peripheral devices to a computer via a single high density connector.

One prior art peripheral interconnection device has a cable with a plug on one end and a hemispherical housing on the other end with various jacks disposed on opposing sides of the housing. The jacks are commonly connected to a high density connector for interface with a computer. Indicia in the pockets indicates the proper plug/jack interface. However, such a device is symmetrically shaped such that it is difficult to easily distinguish the input jacks from the output jacks. Also, such a device has a very large footprint, yet only has a limited number and type of jacks. The hemispherical shape of the prior art device also prohibits stacking of other peripheral cable housings or other devices thereon. For example, when a plurality of high density expansion boards or other peripheral devices are used, such a device cannot share a common footprint and valuable working surface area is wasted. Also, such a device does not accommodate necessary input/output signaling.

Therefore, there is a need for a high density interconnection device that is relatively small, stackable, accommodates more input/output signaling, and intuitively informs a user of the proper interface.

BRIEF DESCRIPTION OF THE DRAWINGS

The invention may best be understood by reference to the following description taken in conjunction with the accompanying drawings, in the several figures of which like reference numerals identify like elements.

DETAILED DESCRIPTION OF A PREFERRED EMBODIMENT OF THE INVENTION

The high density interconnection device of the present invention is primarily for use in connection with interfacing peripheral devices to an electronic device such as a computer or other suitable electronic device. The high density audio/video input/output interconnection device includes a high density connector block, a high density connector, and a plug. The high density connector block has a plurality of jacks located on the outer surface thereof, such as a S-video input jack, a S-video output jack, a composite video input jack, a composite video output jack, a digital audio output jack, a right channel audio input jack and a left channel audio input jack. The high density connector is commonly connected to the plurality of jacks via a first cable, so that the suitable peripheral devices may be interfaced with a computer or other electronic device. The plug is connected to the high density connector via a second cable for right and left channel audio output. In one embodiment, the high density connector block further includes a digital video input/output jack or an infrared transceiver.

The high density connector block includes a housing having top, bottom, front, back, first side, and second side surfaces. The first and second side surfaces are disposed on opposite sides of a longitudinal axis. The plurality of jacks are disposed on the first and second side surfaces. In one embodiment, a recessed portion is formed in the first side surface defined by a first multi-faceted surface having a plurality of first surface elements angularly disposed to one another. A projecting portion is formed in the second side surface defined by a second multi-faceted surface having a plurality of second surface elements angularly disposed to one another. The first cable is associated with the back surface. Preferably, at least one jack on the first side surface is disposed in the recessed portion, and at least one jack on the second side surface is disposed in the projecting portion. In one aspect, the audio jacks disposed on the first and second side surfaces are defined in a first plane, and the video jacks disposed on the first and second side surfaces are defined in a second plane. The first and second planes are substantially parallel such that the audio and video jacks are offset.

Figure 1:
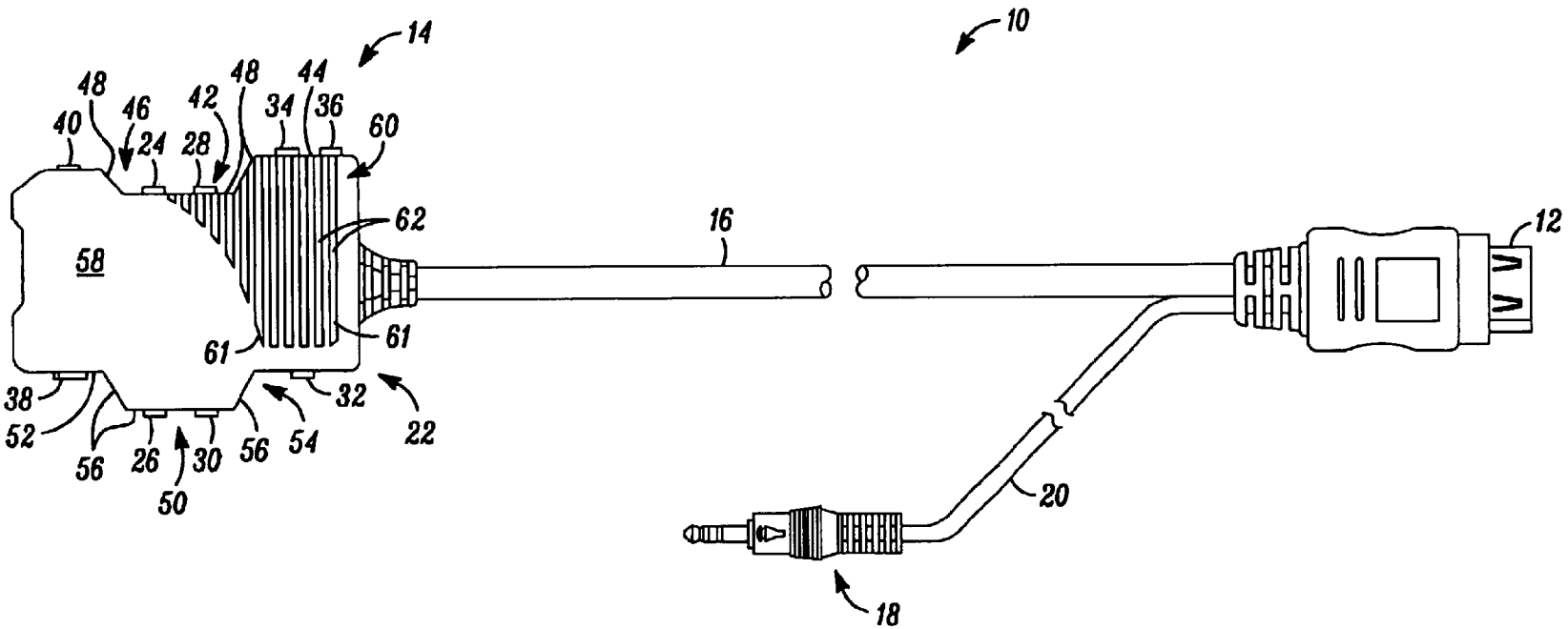
FIG. 1 is a top plan view of a high density interconnection device in accordance with one embodiment of the present invention.

FIG. 1 is a perspective view of the high density audio/video input/output interconnection device 10 of one embodiment of the present invention. The interconnection device 10 includes a high density connector 12, a high density connector block 14 connected to the high density connector 12 via a first cable 16, and a plug 18 connected to the high density connector 12 via a second cable 20. The high density connector 12 commonly interconnects the input/output jacks of the high density connector block 14 and the plug 18 to a computer. As is well known in the art, a plurality of pins extend from the high density connector 12 to interface with a high density socket disposed on an expansion board.

The high density connector block 14 includes a plurality of audio/video input/output jacks disposed on a housing outer surface 22 including a S-video input jack 24, a S-video output jack 26, a composite video input jack 28, a composite video output jack 30, a digital audio output jack 32, a right channel audio input jack 34, a left channel audio input jack 36, a digital video input/output jack 38, and an infrared transceiver jack 40. The first cable 16 commonly interconnects the plurality of jacks 24–40 to the high density connector 12.

The plug 18 is a conventional mini-phone connector for right and left channel audio output. This plug 18 is optional. It will be recognized that any other suitable plug may also be used.

A recessed portion 42 is formed in the first side surface 44 defined by a first multi-faceted surface 46 having a plurality of first surface elements 48 angularly disposed to one another in the first side surface 44. At least one of the plurality of jacks 24–40 are disposed within the recessed portion 42. In this example, input jacks are disposed within the recessed portion. Among other aspects, the recessed portion visually, i.e. intuitively, indicates that input signals are received in this portion of the block.

A projecting portion 50 is defined on the second side surface 52 including a second multi-faceted surface 54 having a plurality of second surface elements 56 angularly disposed to one another and the second side surface 52. At least one of the plurality of jacks 24–40 is disposed on the projecting portion 50. In this example, output jacks are disposed within the projecting portion. Among other aspects, the projecting portion visually, i.e. intuitively, indicates that output signals emanate from this portion of the block. It is within the teachings of the present invention that other contours, or even different shapes could be utilized for the recessed and projecting portions.

The top surface 58 includes a grip enhancing portion 60 having a plurality of ribs 62 for increasing an operator's ability to grip the high density connector block 14. The ribs 62 are defined by a plurality of slots 61 formed in the top surface 58 such that the top of the ribs 62 are substantially coplanar with the top surface 58. Other configurations of the ribs 62 in a grip enhancing portion 60 could be utilized with the present invention. For example, the ribs may be formed as projecting from the top surface defining slots therebetween. Also, the ribs may be segmented along their length.

Figure 2:
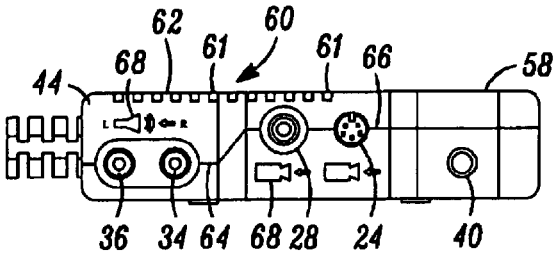
FIGS. 2 and 3 are respective side elevation views of first and second sides of a high density connector block in accordance with one embodiment of the present invention.
Figure 3:
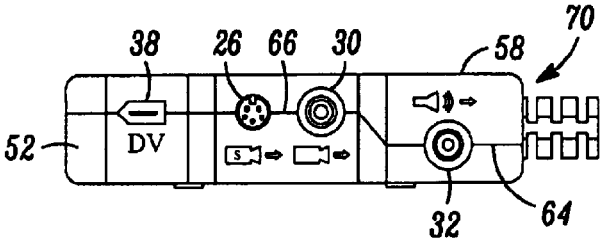

FIGS. 2 and 3 are side elevation views of the first side surface 44 and the second side surface 52 of one example of the present invention. The first side surface 44 has a plurality of audio/video input jacks disposed thereon, including the S-video input jack 24, the composite video input jack 28, the right channel audio input jack 34, and the left channel audio input jack 36. An infrared transceiver jack 40 may also be disposed on the first side surface 44 for remote location of the infrared transceiver. It is within the teachings of the present invention that the infrared transceiver may also be disposed on the first side surface 44 or any other suitable surface. The right channel audio input jack 34 and the left channel audio input jack 36 are defined in a first plane 64 represented by the line bisecting each jack 34 and 36. The S-video jack 24 and the composite video input jack 28 are defined in a second plane 66 represented by the line bisecting each jack 24 and 28. The first plane 64 and the second plane 66 are substantially parallel such that the audio 34 and 36 and video 24 and 28 jacks are offset. Indicia 68 is preferably provided in connection with each of the jacks 24, 28, 34 and 36 to indicate the proper plug/jack interface and connection.

The plurality of audio/video output jacks disposed on the second side surface 52 includes the S-video output jack 26, the composite video output jack 30, the digital audio jack 32, and the digital video input/output jack 38. The digital audio jack 32 is defined in the first plane 64 represented by the line bisecting the jack 32. The S-video output jack 26, the composite video output jack 30 and the digital video input/output jack 38 are defined in the second plane 66 represented by the line bisecting each jack 26, 30 and 38. The first plane 64 and the second plane 66 are substantially parallel such that the audio 32 and video jacks 26, 30 and 38 are offset. In this example, the first 64 and second 66 planes on the first 44 and the second 52 side surfaces are at substantially the same elevation with respect to the high density connector block 14 such that all the audio jacks 32, 34 and 36 are defined in the first plane 64 and all the video jacks 24, 26, 28, 30 and 38 are defined in the second plane 66. Among other aspects, the planes which bisect the groups of jacks are disposed at different levels indicating that audio signals are associated with the first lower plane and that the video signals are associated with the second upper plane. Other configurations for separating the audio and video jacks relative to one another could be utilized with the present invention. For example, the video jacks could be disposed adjacent the back surface 70.

Figure 4:
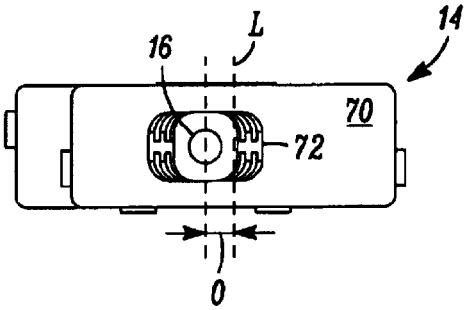
FIG. 4 is a rear elevation view of a back of the high density connector block in accordance with one embodiment of the present invention.

FIG. 4 is a rear elevation view of the back surface 70 of the high density connector block 14. The first cable 16 is connected to the high density connector block 14 by a strain relief 72. The first cable 16 is disposed offset from the longitudinal axis L of the high density connector block 14 at a distance D to provide an asymmetrical cable location with respect to the block.

Figure 5:
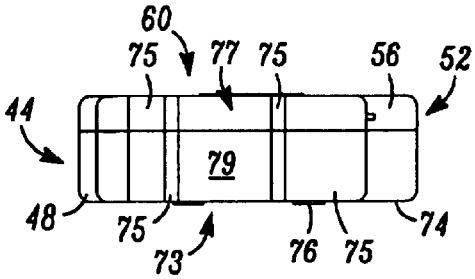
FIG. 5 is a front elevation view of a front of the high density connector block in accordance with one embodiment of the present invention.

FIG. 5 is a front elevation view of the front surface 73 of the high density connector block 14, separate from and inter-connecting the first and second side surfaces 44 and 52. A plurality of front surface elements 75 form the front surface 73 including, in this embodiment, a front recessed portion 77 formed in the front surface 73 having a front offset surface 79 set off from the front surface 73 by a pair of angularly disposed front surface elements 75. In this example, the front surface 73 includes a recessed portion 77. Other configurations for the front surface may be utilized, for example, the front surface may be formed within one linear plane, or a projecting portion may be formed on the front surface.

Figure 6:
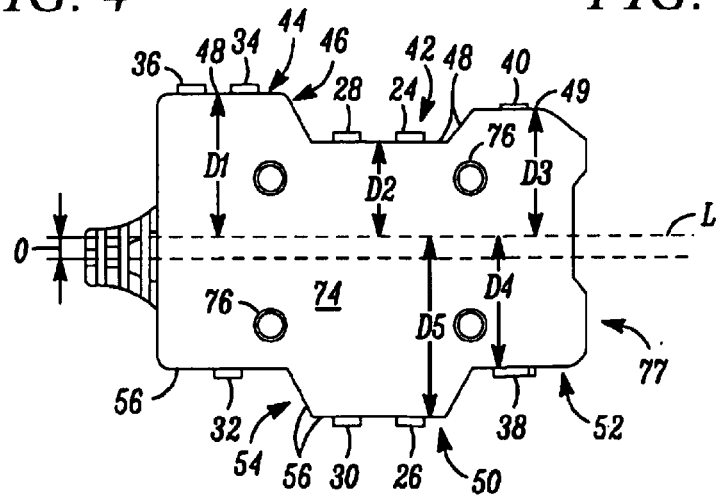
FIG. 6 is a bottom plan view of a bottom of the high density connector block in accordance with one embodiment of the present invention.

FIG. 6 is a bottom plan view of the bottom surface 74 of the high density connector block 14. A plurality of feet 76 extend from the bottom surface 74 in order to enable stable mounting of the high density connection block 14, and to provide adequate spacing when stacking like high density connector blocks 14 one on top of the other. Also shown in FIG. 6, at least one of the jacks on each of the first 44 and second 52 side surfaces is disposed within the recessed 42 and projecting 50 portions. All of the input jacks 24, 28, 34, and 36 are disposed on the first side surface 44. The recessed portion 42 on the first side surface 44 intuitively represents and informs the operator that the first side surface 44 is for input interface and connection. Likewise, the second side surface 52 includes output jacks 26, 30, and 32 and a projecting portion 50. The operator intuitively recognizes that the second side surface 52 is for output interface and connection by virtue of the projecting portion 50.

The recessed portion 42 is defined by a multi-faceted surface 46 having a plurality of first surface elements 48 disposed at an angle to one another and to the first side surface 44. As shown, one of the first surface elements 48 is offset from the first side surface 44 such that the first side surface 44 is disposed at a first distance D1 from the longitudinal axis L which is greater than a second distance D2 associated with the offset first surface element 48. The offset first surface element 48 may be substantially parallel to the first side surface 44. As noted above, preferably, at least one of the audio/video input jacks is disposed within the recessed portion 42 on the offset first surface element 48. The first side surface 44 further includes a second offset first surface element 49 which may be parallel to the first side surface 44 and is disposed at a third distance D3 from the longitudinal axis L which is less than the first distance D1.

The projecting portion 50 is defined by a multi-faceted surface 54 having a plurality of second side surface elements 56 disposed at an angle to one another and to the second side surface 52. The projecting portion 50 includes a second side surface element 56 offset from the second side surface 52 such that the second side surface 52 is disposed at a fourth distance D4 to the longitudinal axis L, which is less than a fifth distance D5 associated with the offset second side surface element 56. At least one second side surface element 56 may be parallel to the second side surface 52. As noted above, preferably, at least one of the audio/video output jacks is disposed within the projecting portion 50 on the offset second side surface element 56.

Figure 7:
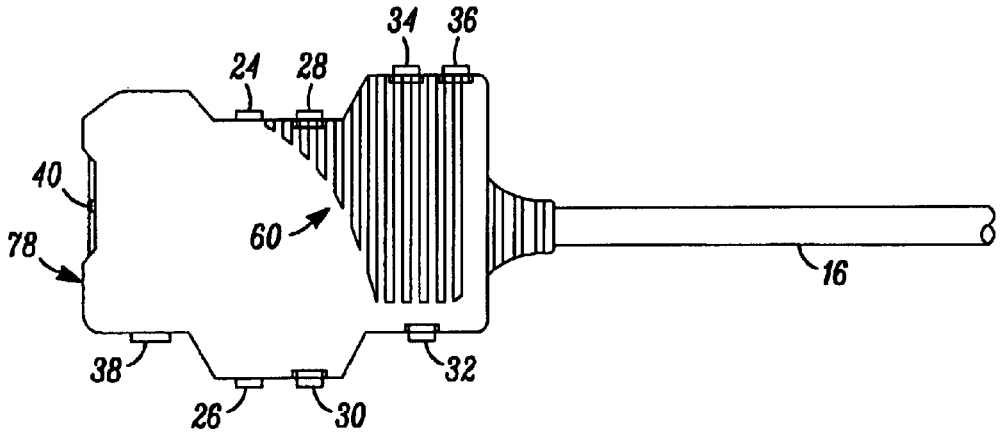
FIG. 7 is a top plan view of an alternative embodiment of the high density connector block in accordance with one embodiment of the present invention.
Figure 8:
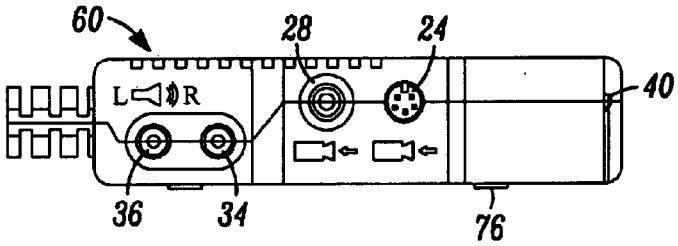
FIG. 8 is a side elevation view of a first side of the high density connector block of FIG. 7.
Figure 9:
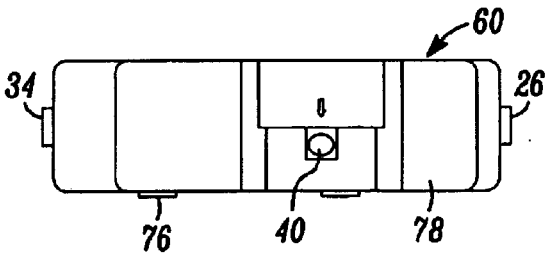
FIG. 9 is a front elevation view of a front of the high density connector block of FIG. 7.

FIGS. 7 to 9 show top plan, side elevation, and front elevation views of an alternative embodiment of the present invention. In this embodiment, the location of the infrared transceiver 40 is moved so that it is disposed on the front surface 78 of the high density connector block 14. Preferably, the front side surface 78 is separate from the first side surface 44 and the second side surface 52. Further, in this embodiment, the infrared transceiver 40 is separated from the audio and video input and output jacks.

As shown in the disclosed embodiment, the high density interconnection device of the present invention can provide a high density connector block that is small, stackable and provides intuitively recognizable interface instructions.

The invention is not limited to the particular details of the apparatus depicted and other modifications and applications may be contemplated. For example, the high density connector may have various different configurations in order to accommodate the number of peripheral devices. For example, the recessed and projecting portions may have additional surface elements and may be formed as rounded surface elements. Also, various structures and configurations may be used for the recessed and projecting portions of the present invention. Also, more input/output jacks may be used if desired. Certain other changes may be made in the above-described apparatus without departing from the true spirit and scope of the invention here involved. It is intended, therefore that the subject matter of the above depiction shall be interpreted as illustrated and not in a limiting sense.

We claim:

1. A high density audio/video input/output interconnection device comprising:

a high density connector block that includes a plurality of jacks disposed on an outer surface of the high density connector block including, a S-video input jack, a S-video output jack, a composite video input jack, a composite video output jack, a digital audio output jack, a right channel audio input jack and a left channel audio input jack;

the plurality of input jacks disposed on a first side surface and the plurality of output jacks disposed on a second side surface;

a high density connector that interfaces with a computer commonly interconnected to the plurality of jacks via a first cable; and, a plug for stereo audio output connected to the high density connector via a second cable.

2. The connector as recited in claim 1, wherein the plurality of jacks further include a digital video input/output jack.

3. The connector as recited in claim 1, wherein the high density connector block further includes a jack for interconnection with an infrared transceiver.

4. The connector as recited in claim 1, wherein the plurality of input jacks are disposed on opposing side from the plurality of output jacks.

5. The connector as recited in claim 1, wherein the high density connector block further includes an infrared transceiver disposed on a surface of the high density connector block separate from a first side surface of the plurality of input jacks and the second side surface of the plurality of output jacks.

6. The connector as recited in claim 1, wherein the first side surface includes a multi-faceted recessed portion and the second side surface includes a multi-faceted projecting portion, wherein the recessed portion and corresponding projecting portion are defined by a plurality of surface elements.

7. A high density audio/video input/output connector block, comprising:

a housing having a longitudinal axis and including a top surface, a bottom surface, a front surface, a back surface, a first side surface, and a second side surface, such that the first and second side surfaces are oppositely disposed;

a plurality of input jacks, for interconnection with peripheral devices, disposed on the first side surface and a plurality of output jacks, for interconnection with peripheral devices, disposed on the second side surfaces;

a recessed portion formed on the first side surface having at least one of the plurality of input jacks disposed therein;

a projecting portion formed on the second side surface having at least one of the plurality output of jacks disposed therein; and, a cable associated with the back surface.

8. The connector as recited in claim 7, wherein the plurality of input jacks disposed on the first side surface includes at least one jack selected from the group consisting of a S-video input jack, a composite video input jack, an audio right channel input jack, an audio left channel input jack.

9. The connector as recited in claim 7, wherein the plurality of output jacks disposed on the second side surface includes at least one jack selected from the group consisting of a digital video input/output jack, a S-video output jack, a composite video output, and a digital audio output jack.

10. The connector as recited in claim 7, wherein the high density connector block further includes an infrared transceiver associated therewith.

11. The connector as recited in claim 10, wherein the infrared transceiver is disposed on the front surface.

12. The connector as recited in claim 7, wherein the top surface further includes a grip enhancing portion defined by a plurality of ribs for increasing an operator's ability to grip the high density connector block.

13. The connector as recited in claim 7, wherein the cable is disposed offset from the longitudinal axis.

14. The connector as recited in claim 7, wherein the recessed portion includes a first surface element offset from the first side surface such that the first side surface is disposed at a first distance from the longitudinal axis which is greater than a second distance associated with the offset first surface element.

15. The connector as recited in claim 7, wherein the projecting portion includes a second side surface element offset from the second side surface such that the second side surface is disposed at a fourth distance from the longitudinal axis which is less than a fifth distance associated with the offset second side surface element.

16. The connector as recited in claim 7, wherein the recessed and projecting portions each further include at least one surface element which is parallel to the first and second side surfaces.

17. The connector as recited in claim 7, wherein the recessed portion includes a first multi-faceted surface having a plurality of first surface elements angularly disposed to one another.

18. The connector as recited in claim 7, wherein the projecting portion includes a second multi-faceted surface having a plurality of second surface elements angularly disposed to one another.

19. A high density audio/video input/output connector block, comprising:

a housing including a first side surface and a second side surface, and having a longitudinal axis;

at least one audio input jack disposed on the first side surface and at least one audio output jack disposed on the second side surface, both defined in a first plane; and, at least one video input jack disposed on the first side surface and at least one video output jack disposed on the second side surface, both defined in a second plane, where that the first and second planes are substantially parallel such that the audio and video jacks are offset.

20. The connector as recited in claim 19, wherein the first side surface further includes a recessed portion.

21. The connector as recited in claim 20, wherein at least one video jack disposed on the first side surface is disposed within the recessed portion.

22. The connector as recited in claim 19, wherein the second side surface further includes a projecting portion.

23. The connector as recited in claim 22, wherein at least one video jack disposed on the second side surface is disposed within the projecting portion.

24. The connector as recited in claim 19, wherein the housing further includes an infrared transceiver associated therewith.

25. The connector as recited in claim 24, wherein the infrared transceiver is disposed on a surface separate from the audio and video jacks.

26. A high density audio/video input/output interconnection device, comprising:

a high density connector for engagement with a computer connected to a first end of a first cable and a first end of a second cable;

a high density connector block connected to a second end of the first cable for interconnection with peripheral devices and in common communication with the high density connector;

the high density connector block including a top surface, a bottom surface, a front surface, a back surface, a first side surface, and a second side surface, such that the first and second side surfaces are oppositely disposed;

a recessed portion formed on the first side surface where a first plurality of jacks are disposed on the first side surface including within the recessed portion for interconnection with peripheral devices;

a projecting portion forward on the second side surface where a second plurality of jacks are disposed on the second side surface including within the projecting portion for interconnection with peripheral devices;

the first plurality of jacks disposed on the first side selected from the group consisting of a S-video input jack, a composite video input jack; an audio right channel input jack, an audio left channel input jack, and an infrared transceiver jack;

the second plurality of jacks disposed on the second side are selected from the group consisting of a digital input/output jack, a S-video output jack, a composite video output jack, and a digital audio output jack; and, a multi-channel audio plug connected to a second end of the second cable.

27. The connector as recited in claim 26, wherein the top surface further includes a grip enhancing portion defined by a plurality of ribs formed in the top surface.

28. The connector as recited in claim 26, wherein the audio jacks on the first and second side surfaces are defined in a first plane and the video jacks disposed on the first and second side surfaces are defined in a second plane where the first and second planes are offset substantially parallel such that the audio and video jacks are offset.

29. A high density audio/video input/output interconnection device comprising:

a high density connector block that includes a plurality of jacks disposed on an outer surface of the high density connector block including, a S-video input jack, a S-video output jack, a video input jack, a video output jack, at least one audio output jack and at least one audio input jack;

the plurality of input jacks disposed on a first side surface and the plurality of output jacks disposed on a second side surface;

a high density connector that interfaces with a computer commonly interconnected to the plurality of jacks via a first cable; and, a plug for stereo audio output connected to the high density connector via a second cable.

30. The connector as recited in claim 29, wherein the plurality of jacks further include a digital video input/output jack.

31. The connector as recited in claim 29, wherein the high density connector block further includes a jack for interconnection with an infrared transceiver.

32. The connector as recited in claim 29, wherein the plurality of input jacks are disposed on opposing side from the plurality of output jacks.

33. The connector as recited in claim 29, wherein the high density connector block further includes an infrared transceiver disposed on a surface of the high density connector block separate from a first side surface of the plurality of input jacks and the second side surface of the plurality of output jacks.

34. The connector as recited in claim 29, wherein the first side surface includes a multi-faceted recessed portion and the second side surface includes a multi-faceted projecting portion, wherein the recessed portion and corresponding projecting portion are defined by a plurality of surface elements.

* * * * *